US005992963A

United States Patent [19]

Miyake et al.

[11] Patent Number: 5,992,963

[45] Date of Patent: Nov. 30, 1999

[54] PRINTING APPARATUS AND METHOD FOR CONTROLLING THE TEMPERATURE OF A PRINTING HEAD WITH HEATING AND COOLING DEVICES

[75] Inventors: Hiroyuki Miyake; Mitsuru Kurata, both of Kawasaki; Tokihide Ebata, Yokohama; Hiroyuki Kuriyama; Yasushi Miura, both of Kawasaki; Takeshi Irizawa, Tokyo, all of Japan

[73] Assignee: Canon Kabushiki Kaisha, Tokyo, Japan

[21] Appl. No.: 08/525,369

[22] Filed: Sep. 7, 1995

[30] Foreign Application Priority Data

Sep. 9, 1994 [JP] Japan ..... 6-215897

[51] Int. Cl.[6] ..... B41J 29/377; B41J 29/38

[52] U.S. Cl. ..... 347/18; 347/17

[58] Field of Search ..... 347/18, 48, 223, 347/185, 186, 106, 17, 26; 101/487; 400/124.03, 124.13; 165/80.4

[56] References Cited

U.S. PATENT DOCUMENTS

| | | | |
|---|---|---|---|
| 3,856,201 | 12/1974 | Genever-Watling et al. | 236/93 |
| 4,313,124 | 1/1982 | Hara . | |
| 4,345,262 | 8/1982 | Shirato et al. . | |
| 4,459,600 | 7/1984 | Sato et al. . | |
| 4,463,359 | 7/1984 | Ayata et al. . | |
| 4,558,333 | 12/1985 | Sugitani et al. . | |
| 4,608,577 | 8/1986 | Hori . | |
| 4,660,056 | 4/1987 | Yokoi | 347/17 |
| 4,712,172 | 12/1987 | Kiyohara et al. | 347/60 |
| 4,719,472 | 1/1988 | Arakawa | 347/17 |
| 4,723,129 | 2/1988 | Endo et al. . | |
| 4,740,796 | 4/1988 | Endo et al. . | |
| 4,791,453 | 12/1988 | Koseki et al. | 399/82 |
| 4,860,034 | 8/1989 | Watanabe et al. | 347/14 |
| 4,910,528 | 3/1990 | Firl et al. . | |
| 4,929,963 | 5/1990 | Balazar . | |
| 4,947,194 | 8/1990 | Kyoshima | 347/14 |
| 5,017,941 | 5/1991 | Drake | 347/18 |
| 5,084,713 | 1/1992 | Wong . | |
| 5,107,276 | 4/1992 | Kneezel et al. . | |
| 5,172,134 | 12/1992 | Kishida et al. | 347/13 |
| 5,291,215 | 3/1994 | Nozawa et al. | 347/18 |
| 5,381,164 | 1/1995 | Ono | 347/186 |
| 5,512,924 | 4/1996 | Takada et al. | 347/42 |
| 5,623,292 | 4/1997 | Shrivastava et al. | 347/18 |
| 5,689,292 | 11/1997 | Suzuki et al. | 347/17 |
| 5,798,772 | 8/1998 | Tachihara et al. | 347/11 |

FOREIGN PATENT DOCUMENTS

| | | | |
|---|---|---|---|
| 0317341 | 5/1989 | European Pat. Off. . | |
| 0 390 202 | 10/1990 | European Pat. Off. . | |
| 000 461 936 | 12/1991 | European Pat. Off. | 347/57 |
| 0 573 062 | 12/1993 | European Pat. Off. . | |
| 5-73062 | 12/1993 | European Pat. Off. . | |

(List continued on next page.)

*Primary Examiner*—N. Le
*Assistant Examiner*—Thien Tran
*Attorney, Agent, or Firm*—Fitzpatrick, Cella, Harper & Scinto

[57] ABSTRACT

An ink jet printing apparatus for industrial use, which is provided with a comparatively large number of nozzles arranged for high duty recording, particularly an ink jet textile printing apparatus, and an ink jet printing apparatus suitably used for printing on a large-sized medium, are provided together with a method for controlling the temperature of the printing head of such high duty printing apparatuses, and various other types of printing apparatuses reliably. To the large number of heaters used for recording in a printing step, driving signals are applied to cause them to discharge ink for recording and, to the discharge heaters that are not to perform recording, secondary driving signals that do not allow ink to discharge are applied. These secondary driving signals cause the heaters not used in recording to generate heat, so as to reduce unevenness in the intensities of heat generation among the many discharge heaters of the printing head. At the same time, cooling water is supplied by a cooling device to a cooling liquid path arranged for the printing head in order to cool it.

24 Claims, 7 Drawing Sheets

FOREIGN PATENT DOCUMENTS

| | | |
|---|---|---|
| 54-056847 | 5/1979 | Japan . |
| 59-123670 | 7/1984 | Japan . |
| 59-138461 | 8/1984 | Japan . |
| 60-071260 | 4/1985 | Japan . |
| 60-248357 | 12/1985 | Japan . |
| 61-017670 | 5/1986 | Japan . |
| 61-112664 | 5/1986 | Japan . |
| 61-146550 | 7/1986 | Japan . |
| 61-189948 | 8/1986 | Japan . |
| 61-249763 | 11/1986 | Japan . |
| 62-053492 | 3/1987 | Japan . |
| 62-041114 | 9/1987 | Japan . |
| 62-220345 | 9/1987 | Japan . |
| 63-116857 | 5/1988 | Japan . |
| 63-134249 | 6/1988 | Japan . |
| 1-127361 | 5/1989 | Japan . |
| 1-133748 | 5/1989 | Japan . |
| 3-004394 | 1/1991 | Japan . |
| 3-043254 | 2/1991 | Japan . |
| 3-046589 | 7/1991 | Japan . |
| 4-047948 | 2/1992 | Japan . |

PRINTING APPARATUS AND METHOD FOR CONTROLLING THE TEMPERATURE OF A PRINTING HEAD WITH HEATING AND COOLING DEVICES

BACKGROUND OF THE INVENTION

1. Field of the Invention

The present invention relates to a printing apparatus to form images in accordance with image signals or image information obtainable from images on source documents. Specifically, the invention relates to a printing apparatus to which an ink jet recording method, thermal transfer method, or other recording methods are applicable. More particularly, it relates to a printing apparatus using an ink jet recording method capable of recording in high recording duties with the provision of many numbers of discharge nozzles.

Printing apparatuses of the present invention are those applicable as a textile printing apparatus to print on fabrics, a printing apparatus adapted for industrial use, or the like.

2. Related Background Art

There has been known an ink jet recording method whereby to record by discharging ink from discharge ports onto a recording medium and cause it to adhere to the medium. This ink jet recording method is widely used for comparatively small print output apparatuses for personal use. In a printing apparatus using such ink jet recording method, the temperature of printing head changes depending on the history of printing operations and recording duties. Then, as the temperature changes, its recording density is caused to vary, leading to unevenness created in recorded images. Particularly when the printing operation is carried out continuously or a high duty recording is performed, the temperature rise of the recording head becomes intense, making it difficult even to discharge ink in some cases. Also, in a printing apparatus capable of recording in colors with the provision of printing heads arranged respectively for each of plural colors, unevenness is created in each color used for recording, hence causing the ratio of color mixture to be varied when forming an image by mixing plural colors. It is inevitable that the color appearance varies in an image thus printed.

On the other hand, in a printing apparatus having a smaller number of nozzles to discharge ink, which prints at a comparatively slow speed, the heat generation of the printing head is also comparatively small. For such printing apparatus, the following proposals have been made in anticipation of solving the problems related to the temperature rise of printing head:

1) In U.S. Pat. No. 4,910,528, a technique is disclosed to suppress the excessive rise of temperature by detecting the temperature of printing head, thus controlling its printing speed accordingly so that the temperature of the printing head is adjusted.

2) In Japanese Patent Publication No. 3-4394, a technique is disclosed to suspend printing operation when the temperature of printing head exceeds a given temperature, and then, to resume the printing operation after waiting for the temperature to drop.

3) In Japanese Patent Publication No. 61-17670 and Japanese Patent Publication No. 62-41114, a technique is disclosed to control printing speeds by grasping printing duties in advance in accordance with recording data so that the temperature of the printing head is kept at a constant level.

4) In Japanese Patent Laid-Open Application Nos. 1-127361, 3-43254, and 4-47948, a technique is disclosed to stabilize the temperature of printing head in such a manner that while applying printing signals in an intensity good enough to generate thermal energy to the heaters of ink discharge nozzles that discharge ink, signals are applied to the nozzles that do not discharge ink in an intensity just to generate thermal energy but not strong enough to cause ink to be discharged, and that the resultant heat generation is made constant for the printing head: here, the arrangement of such means is well balanced with the arrangement of natural cooling.

5) In U.S. Pat. No. 4,929,963, a technique is disclosed to implement the cooling of a printing head by circulating ink itself in the interior of the printing head.

6) In EP Patent No. 573,062, a technique is disclosed to provide a mechanism to cause cooling water to pass a thermal transfer printing head, thus forcibly cooling such head by use of the cooling water.

In each of the proposals described above, however, the following problems are encountered:

In the paragraphs 1) to 3) described above, the temperature of the printing head is prevented from rising by the utilization of natural radiation. Thus the temperature of the printing head is not controlled, to be exact. As a result, if the recording duty is high, the printing speed is reduced, and also, there is a fear that the recording densities vary. Should a technique of the kind be applied to an ink jet textile printer or an ink jet printer for industrial use, the temperature rises immediately because such printers are provided with a large number of nozzles, and the recording duty is high, resulting in an enormous amount of heat generation. Therefore, such printer tends to suspends its operation frequently in order to allow its printing head to be cooled. Also, in this case, even if the printing speed is reduced, it is impossible to avoid the temperature rise of the printing head because of an enormous number of nozzles to be used. In any case, a printer of the kind makes it difficult to effectuate a continuous operation. Also, it is difficult to suppress the variation of recording densities due to the frequent changes of temperature while executing the printing operation.

In the technique described in the above paragraph 4), it is arranged that in addition to the energy for discharging ink, energy for generating heat is given even when no ink is discharged in order to make the heat generation of the printing head constant, and then, on the assumption that the natural radiation is constant, an arrangement is made to make the heat generation of the printing head well balanced with the natural radiation. In this way, the temperature of the printing head is stabilized at a constant level.

With this arrangement, however, the total amount of heat generation of the printing head becomes enormous, resulting in a more intensive rise of temperature than that of the examples referred to in the above paragraphs 1) to 3). Thus, the continuous operation becomes more difficult. In order to perform the operation continuously, the nozzle numbers should be smaller, and also, the printing speed is made slower. In addition, the heat generation of the printing head should be smaller so as to be able to anticipate a sufficient natural radiation. Even under such conditions, the balancing point with the natural radiation varies as the inner temperature of the apparatus rises in operation. Further, the balancing point of the head temperature varies eventually as the outside temperature changes.

In the method described in the above paragraph 5), ink is circulated between the printing head and ink tank to cool the printing head. However, the method referred to in that paragraph does not provide any mechanism to adjust the temperature of ink. Therefore, the temperature of circulating ink rises without any control as a printing operation is carried on continuously, leading to the creation of a gradual variation of recording densities after all. Further, before this problem arises, if this method is adapted for a printing head provided with many numbers of nozzles for use of high duty recording, that is, if it is used for cooling a printing head that may generate an enormous heat generation, there is a need for executing the circulation of ink in an amount sufficient enough to effectuate the intended cooling. Then, due to the pressure exerted by such circulating ink, the menisci of ink in the nozzles are broken to allow ink to leak from the nozzles or air to enter the nozzles to mix with ink. In such a case, there is a fear that the printing function itself is even liable to malfunction.

The methods described in the above paragraphs 1) to 5) are all applicable to printing apparatuses having a smaller number of nozzles for the execution of low duty recording, that is, those of a small type for office use, for which it suffices to utilize the natural radiation appropriately, and the variation of recording densities and unevenness in recorded images do not present such a serious problem as in the case of industrial use. For printing apparatuses for industrial use that require high recording duties, demands are so strict with respect to the variation of recording densities and unevenness in recorded images that any one of the methods described above is not adoptable.

Also, the method described in the above paragraph 6) discloses a mechanism using cooling water to cool a specific printing head of a thermal transfer type, but there is no consideration given to any application at all to printing apparatuses of various types including those for industrial use.

As described above, even with the adoption of any one of the conventional methods, it is impossible to materialize an ink jet recording apparatus for industrial use, which is capable of printing in high recording duties with a good color reproducibility of prints without any variation of recording densities and unevenness in the recorded images.

Now, the ink jet technologies have reached the stage almost equal to the technical level of the offset printing in such areas as the image processing technique using error diffusion methods or the like, the graduation expression technique obtainable by the combination of such image processing technique and multiple composition printing; and in the image expression capability obtainable by the application of ink jet recording technique, which uses the wide color reproducibility by means of multicolor printing in six to ten color process beyond the conventional four prime color process.

Also, with such advanced technologies, a serial printing method is now adoptable for printing a screen of wider and longer size, and it is anticipated that the range of application of this method is expandable to the industrial fields such as ink jet textile printing, printing of large image screens, fabrication of color filters for use of display, and some others. However, there are problems yet to be solved as described above in this respect.

The ink jet technologies provide readiness as an output means for the computer publishing that uses a computer as its host device. Also, when applying the technologies, there is no need for the provision of steps to prepare impressions. It is not required to mix ink to obtain colors as desired, either, among other significant advantages. However, due to the problems described above, the application of these technologies has not been sufficiently developed as yet with respect to its use in the industrial fields.

SUMMARY OF THE INVENTION

It is an object of the present invention to provide a printing apparatus preferably suitable for use as an ink jet textile printer, an ink jet printer for industrial use, or the like, particularly having many numbers of nozzles to execute high duty printing, by exactly controlling the temperature of printing heads of various printing types so as to materialize the uniformity of recording densities and the exact reproduction of required color appearance.

The printing apparatus of the present invention is a printing apparatus provided with printing head having a plurality of recording means for printing on a recording medium, the aforesaid printing means being arranged to generate heat along its driving, and provided with a plurality of heat generating means for giving heat to the printing head; cooling means for cooling the printing head; and means for controlling heat generation to control the generated heat by the aforesaid heat generating means so that it becomes equal to the generated heat along the driving of the recording means.

The present invention is effectively applicable to the thermal printing method, ink jet recording method using heaters to discharge ink, or the like. Also, it is effectively applicable to such a method as to discharge ink by use of piezoelectric elements or the like that exert pressure on ink to cause it to be discharged because this method also gives generated heat along the ink discharges.

Also, as another mode, the printing apparatus of the present invention is provided with discharge ports for discharging ink, and a printing head having a plurality of electrothermal transducing elements serving as discharge means to discharge ink from the discharge ports by applying thermal energy to ink for printing on a printing medium by discharging ink onto the medium. This apparatus comprises cooling means to cool the aforesaid printing head; recording control means for recording by selectively driving the aforesaid plurality of discharge means in accordance with printing data; and heat generation control means for generating thermal energy of a range that does not allow ink to be discharged with respect to the discharge means not driven by said recording control means.

Also, the heat generation control means is to control the printing head to be at an appropriate temperature by arranging the discharge means that does not perform discharges to generate the thermal energy equal to the thermal energy given to the printing head along the driving of one discharge means when the discharge of ink is operated by the recording control means.

Also, the electrothermal transducing elements are driven to serve as discharge means by the application of pulsed driving voltage. The heat generation control means may be of such a structure that it applies to the electrothermal transducing elements, which accompanies no recording, the driving pulses whose width is shorter than that of the driving pulses to be applied to the heat generation control means for executing recording by the aforesaid recording control means or of such a structure that it applies the pulses whose width is shorter likewise but applies such pulses several times.

Also, for the cooling means serving as temperature control, it may be possible to adopt various methods, but it is preferable to arrange a structure whereby to cool the printing head by supplying a cooling liquid agent to the printing head. Also, it is possible to control the printing head to keep an appropriate temperature by controlling the flow rate of the cooling liquid agent or the temperature of the liquid.

Also, as another mode of the present invention, a printing apparatus is provided with a printing head having a plurality of recording means for printing on a recording medium. The aforesaid recording means is to generate heat along driving, and the method for controlling the temperature of the printing head of this printing apparatus comprises the heating step to heat the printing head by use of the plurality of heat generation means for heating the printing head, and the heat generated by the heating step is controlled so that it becomes equal to the heat to be generated by the recording means along the driving, and then, it further comprises the cooling step to cool the printing head.

Also, as another mode of the present invention, a printing apparatus is provided with discharge ports to discharge ink, and a printing head having a plurality of electrothermal transducing elements to apply thermal energy to ink, which serves as discharge means for discharging ink from discharge ports, and the method for controlling the temperature of the printing head in this printing apparatus, which records on a recording medium by discharging ink onto the medium, comprises a recording step of recording by selectively driving the aforesaid plurality of discharge means in accordance with printing data; a heat generation controlling step for generating thermal energy of a range that does not allow ink to be discharged; and a cooling step of cooling the printing head by use of cooling means.

The printing apparatus of the present invention is to forcibly cool the printing head, at the same time, causing the heaters provided for the printing head to generate heat, and by combining the cooling and heat generation, the apparatus makes it possible to keep the temperature of the printing head within an appropriate range irrespective of the recording duties given to the printing head.

In this way, it is possible to materialize the enhancement of image quality by applying the present invention to a small ink jet printing apparatus for office use, and also, to an ink jet printing apparatus for industrial use, which is provided with several thousands of multinozzles for the execution of high duty recording (such as a textile printer, a printer for large sized media, machine for fabricating color filters for use of display).

DETAILED DESCRIPTION OF THE PREFERRED EMBODIMENTS

Hereinafter, with reference to the accompanying drawings, the detailed description will be made of the embodiments in accordance with the present invention.

(First Embodiment)

Figure 1:
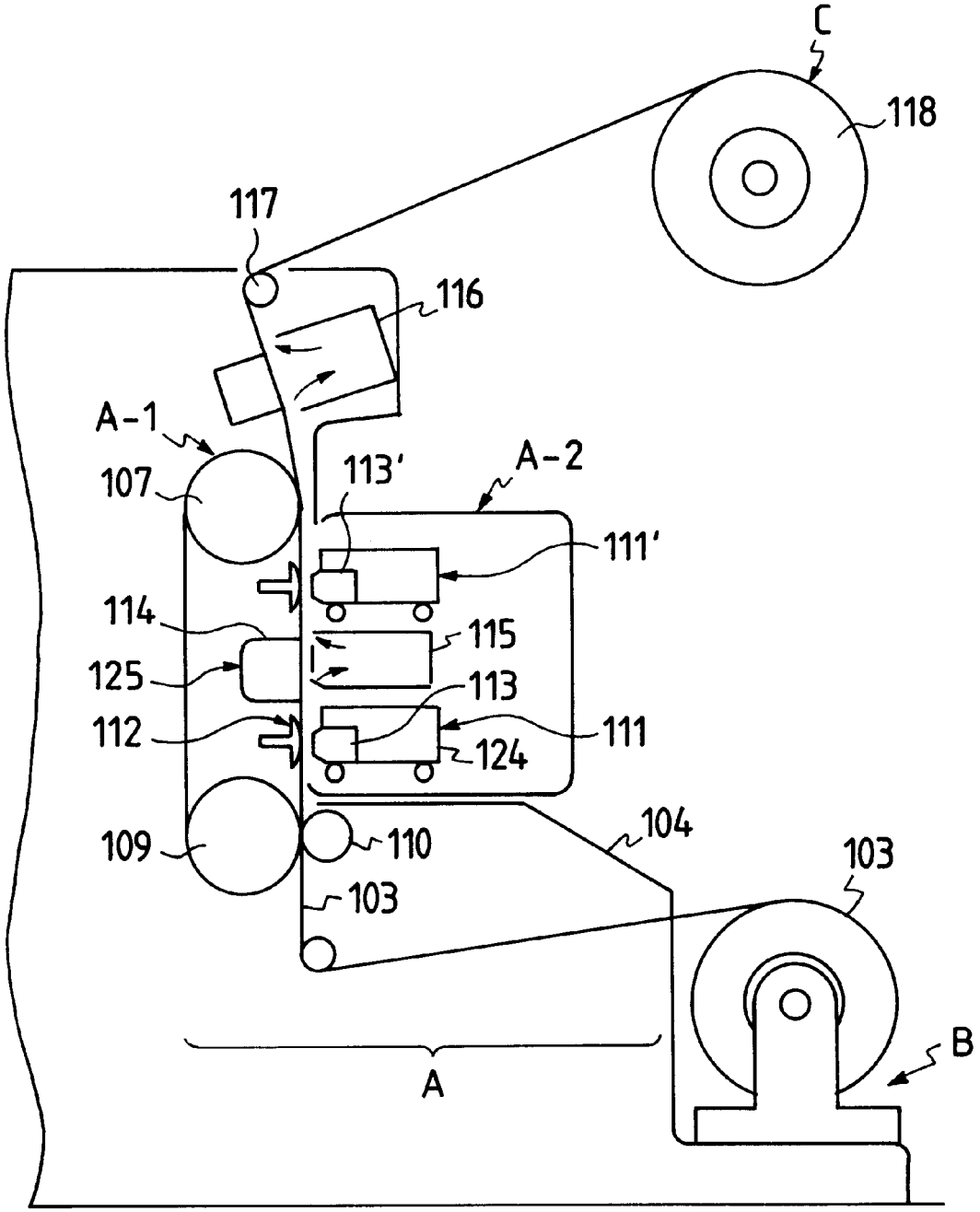
FIG. 1 is a view which schematically shows the structure of the principal part of a printing apparatus which is applicable to an embodiment of the present invention.

The present embodiment is an example in which the invention is applied to a textile printing apparatus to print on fabrics by use of an ink jet recording method. FIG. 1 schematically shows the structure of such apparatus.

The structure of the apparatus embodying the present invention is roughly divided into a cloth supply unit B to send out the rolled cloth 103, which has been given the pretreatment for textile printing, and the main body unit A where printing is performed by discharging ink from ink jet heads 113 and 113' while the cloth 103 thus sent out is being carried step by step precisely, and then, a winding unit C to wind up the printed cloth 103 while drying it. The main body unit A further comprises a precise feed unit A-1 for the cloth 103 including a platen 112, and a printing unit A-2.

The cloth 103 step fed from the cloth supply unit B to the main body unit A is regulated by the platen 112 to provide a flat printing surface in the first printing unit 111. On this printing surface, ink is discharged from the ink jet head 113 to complete printing for one line portion by scanning in the direction from the front to rear sides of the surface of FIG. 1. Each time one line portion is completed, the cloth 103 is step fed for a given amount. Then the portion of the cloth 103 thus printed is heated in a drying unit 125 by means of a heating plate 114 from the rear side of the printing surface of the cloth 103, and dried by means of hot air supplied by and exhausted from a hot air duct 115 arranged on the rear side having the cloth 103 on the heating plate 114 between the duct and the plate. Subsequently, in the second printing unit 111' having the ink jet head 113' in it, a superposed printing is performed on the printed portion of the cloth in the first printing unit 111 in the same manner as in the printing unit 111.

With such structure, printing is performed on a fabric made by mix spinning of cotton and polyester, for example. In such a case, ink discharged from each of the heads 113 and 113' arranged on the upper and lower sides in FIG. 1, respectively, is supposed to be in the same color tone but in different compositions. For example, ink discharged from the head 113' contains reactive dyes having a good dyeing adaptability to cotton, while ink discharged from the head 113 contains disperse dyes having a good dyeing adaptability to polyester. Also, for the superposed printing by means of the heads 113 and 113', each ink is shot on substantially the same spot on the cloth 103 to form one and the same pixel, respectively.

The cloth 103 whose printing is over in the first printing unit 111 and second printing unit 111' is dried again in a drying unit 116 structured in the same way as the drying unit 125 described above. Then it is guided to a guide roller 117 and wound up by the roller 118. The cloth 103 thus wound up is removed from the apparatus, and is given a botch treatment of a coloring step, a rinsing step, and a drying step to complete printing.

Figure 2A:
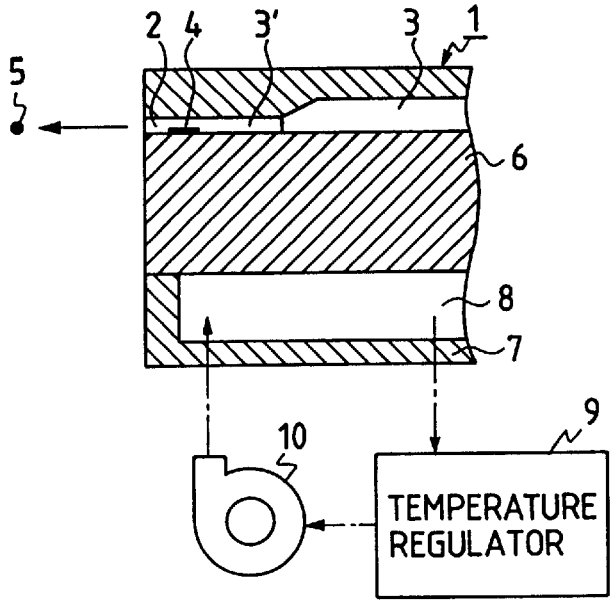
FIGS. 2A to 2C and FIGS. 3A and 3B are views which illustrate the temperature distribution of the nozzle portion of a printing head in accordance with an embodiment of the present invention.
Figure 2B:
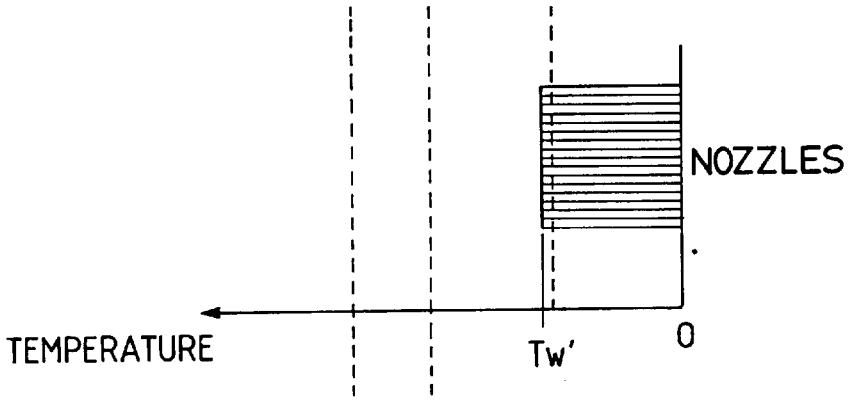
Figure 2C:
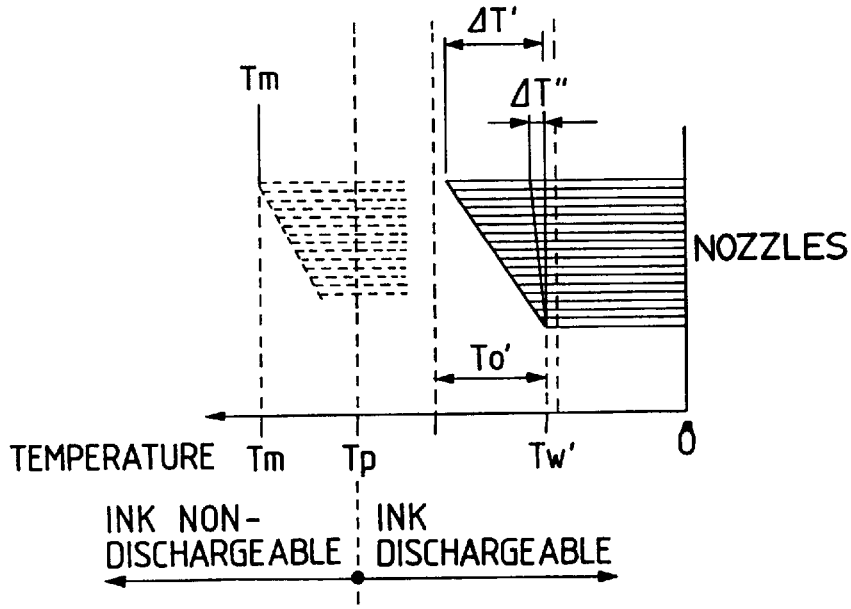

FIG. 2A is a cross-sectional view which shows a multi-head 1 serving as the ink jet heads 113 and 113' described above. FIG. 2B and FIG. 2C are views which illustrate the temperature distribution on the circumference of the nozzles of such multihead 1.

On the multihead 1, there are formed thousand to several thousands of nozzles 2 arranged in the direction from the front to rear sides of the surface of FIG. 2A, FIG. 2A. is a cross-sectional view which shows one nozzle unit of such nozzles 2. Ink is filled in each independent liquid chamber 3' per nozzle 2 from the common liquid chamber 3, and heated instantaneously by means of the discharge heater 4 to which pulse voltage is applied. Ink in the nozzle 2 becomes an ink droplet 5 by means of an air bubble created in ink by the thermal energy thus generated, and discharged onto the cloth 103 (see FIG. 1), which presents itself as a printed material. Each discharge heater 4 is formed on a base plate 6. On the back side of the base plate 6 in the lower part of FIG. 2A, a water jacket 7 is installed. The water jacket 7 carries away the heat from the back side of the base plate 6 by use of cooling water 8. The cooling water 8 is regulated to a given temperature by means of a water temperature regulator 9, and then, supplied by means of a pump 10 to the head 1 again for circulation at a constant speed. FIG. 2B shows the temperature distribution of the nozzles 2 when printing is at rest. The gap between the nozzle 2 and cooling water 8 is arranged each in the direction from the top to bottom in FIG. 2B. In this case, the temperature of the head 1 is uniform as a whole due to the cooling water 8 because there is no heat generated by the heater 4. Therefore, ink discharge begins at a state where the temperature of the nozzle 2 portion is at Tw', which is the temperature of the cooling water 8.

FIG. 2C shows the temperature distribution of the nozzle 2 when printing is in operation. As in the case represented in the FIG. 2B, the gap between the nozzle 2 and cooling water 8 is arranged each in the direction from the top to bottom in FIG. 2C. The temperature of the nozzle 2 portion rises as the heater 4 generates heat for printing. If the recording duty is high (100%, for instance) in order to perform recording all over the surface of a printing material, thus causing the nozzle 2 to discharge ink continuously, the temperature of the nozzle 2 portion rises greatly as at ΔT' in FIG. 2C. If the recording duty is low, the degree of temperature rise is also small as at ΔT" in FIG. 2C.

In order to keep the changing temperature of nozzle 2 portion to be within a target range of temperature $T_0'$, the temperature of cooling water Tw' is set by means of the temperature regulator 9 so that it is kept almost at the lower limit of the target range of temperature $T_0'$. At the same time, a material having a good heat transfer is selected for the base plate 6, and the plate is made thin. In this way, a setup is made so that even when the temperature of the nozzle 2 rises as at ΔT', it does not exceed the target range of temperature $T_0'$.

FIG. 2C is arranged to represent the target range of temperature $T_0'$ as having a considerable width, but if no cooling device is used, the temperature of the nozzle 2 rises to as high as Tm in some cases, which is a temperature far beyond the limit Tp of temperature that makes ink dischargeable. From this point of view, the represented width may be considered comparatively small, which is just good enough to suppress the rise of temperature in such a case. The limit Tp of the temperature that makes ink dischargeable is such that beyond this temperature, the air bubble created by the thermal energy of the heater 4 cannot be eliminated, hence making the next ink droplet 5 non-dischargeable.

Also, the back side of the base plate 6 is in contact with the cooling water 6 whose temperature is kept constant. Therefore, the temperature width of the head 1 is far smaller than that of the conventional examples referred to in the paragraphs 1) to 3) described above, where the back side of the base plate is only in contact with the air outside, and the temperature of the back side of the base plate also rises inevitably.

The present embodiment is sufficiently applicable to the printing apparatus for industrial use if the demand on the recording densities and unevenness in the recorded images is not very strict or the recording duties do not vary, even if the demand is very strict (for example, when it is applied to an apparatus for fabricating color filters for use of display) or the recording duties are low (for example, when applied to printing on a cloth special symbols such as recording initials to be recorded on cloth for making white undershirts).

Also, compared to a second embodiment where the heat generation rate of the printing head is always kept equal to the full duty printing by the application of non-recording signals, which will be described later, the present embodiment does not require any application of energy that corresponds to that of the non-recording signals, and the load to the temperature regulator can be reduced accordingly. Therefore, this embodiment is more advantageous in the implementation of energy saving.

With the present embodiment, it is possible to construct an ink jet printer for industrial use that requires the provision of a large number of nozzles to execute high duty recording. Also, it is possible to keep the temperature changes of the printing head within a specific range, although there is still some room for improvement with respect to the uniformity of temperatures of printing head and the degree of its stabilization.

(Second Embodiment)

FIG. 3A to FIG. 6 are views which illustrate a second embodiment in accordance with the present invention.

Figure 4A:
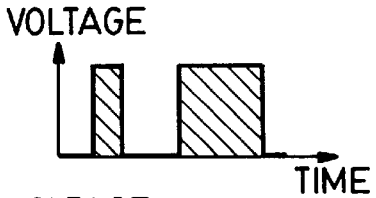
FIGS. 4A and 4B are views which illustrate the recording signals and non-recording signals in accordance with an embodiment of the present invention.
Figure 4B:
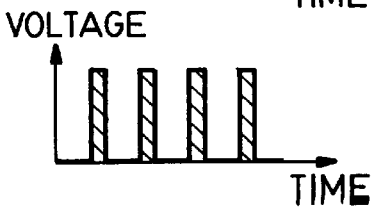

In the present embodiment, the structure of the printing head 1 is the same as the one described in the first embodiment. FIGS. 4A and 4B show the driving signals for the heater 4 of the nozzle 2. FIG. 4A represents the pulsed recording signal required for discharging the ink droplet 5 from the nozzle 2. With two adjacent pulses, one ink droplet 5 is discharged. By regulating the pulse width, gap, or the like of the two adjacent pulses, it is possible to control the size of the ink droplet 5 to be discharged in high precision. This recording signal is applied to the heater 4 of the corresponding nozzle 2 in accordance with the image data. Here, non-recording signal shown in FIG. 4B is applied to the heater 4 to which no recording signal is applied, that is, the heater 4 of the nozzle 2 that is not caused to discharge any ink droplet 5.

In FIG. 4A and FIG. 4B, the areas indicated by slanted lines correspond to the intensities of energy supplied to the heater 4. In the recording signal represented in FIG. 4A, some portions of energy in the areas indicated by slanted lines are removed by the ink droplet 5 as the discharge energy for the ink droplet 5, the thermal energy for the ink droplet 5, and the like, while the remaining energy resides in the printing head 1 as heat.

In FIG. 4B, the pulse is set to be applied as non-recording signal and divided into small ones so as not to discharge any ink droplet 5. Therefore, the energy corresponding thereto remains in the printing head 1 as heat. Then, it is arranged so that the portion of energy of the non-recording signal on the areas indicated by slanted lines in FIG. 4B is substantially equal to the energy remaining as heat in the printing head 1 when the recording signal shown in FIG. 4A is applied in the printing operation.

Figure 5:
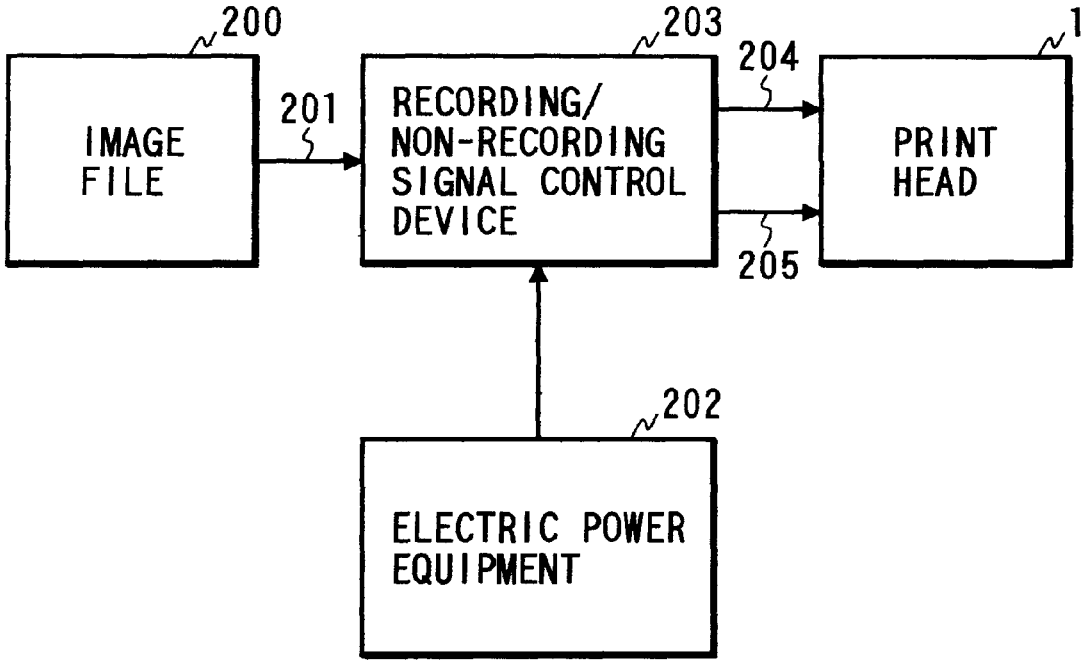
FIG. 5 is a block diagram which shows the control system of a printing head in accordance with an embodiment of the present invention.

FIG. 5 is a diagram schematically illustrating the control system of a printing head.

In FIG. 5, image data 201 transferred from an image data file 200 are carried to a recording/non-recording signal controlling device 203, which receives power from a source-supply 202. Here, the recording signal 104 and non-recording signal 105 are output as shown in FIG. 4A and FIG. 4B, respectively, and then, transmitted to the printing head 1.

In the present embodiment, the description has been made of the structure in which a plurality of pulses are applied as shown in FIG. 4B in the smaller width than those of the recording signal, but the present invention is not necessarily limited thereto. It may be possible to make them the pulses having a lower voltage than that of the recording signal. Also, the number of pulses to be applied by the non-recording signal may be only one. Also, the timing to apply the non-recording signal is not necessarily arranged to agree exactly with the timing to apply the recording signal.

In any case, it will suffice if only the resultant intensity of heat generation of the nozzle 2 is substantially constant irrespective of the discharge of ink droplet 5.

Figure 3A:
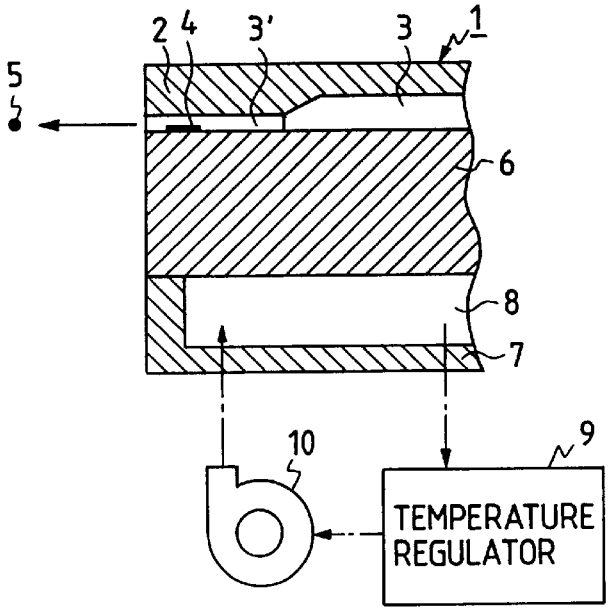
Figure 3B:
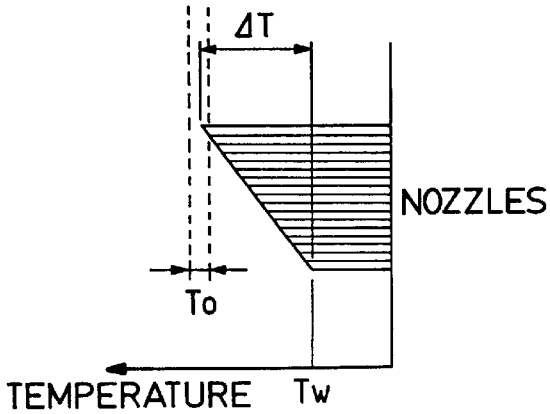

FIG. 3B shows the temperature distribution in the nozzle 2 portion. The cooling of the printing head 1 is the same as that of the first embodiment, that is, the head is cooled at a constant rate by use of cooling water 8. As described above, a setup is made so that the intensity of heat generation of the printing head 1 is always constant irrespective of the discharge of ink droplet 5 from the nozzle 2 while recording is in operation. Therefore, on the base plate 6, the temperature difference $\Delta T$ between the nozzle 2 side and the cooling water 8 side does not depend on the recording duties or the history of recording operations. The difference is always constant. As a result, the temperature near the heater 4 (nozzle temperature) is reliably within an extremely narrow range of target temperature $T_0$ if only the setting and others are appropriate with respect to the temperature of the cooling water 8.

Figure 6:
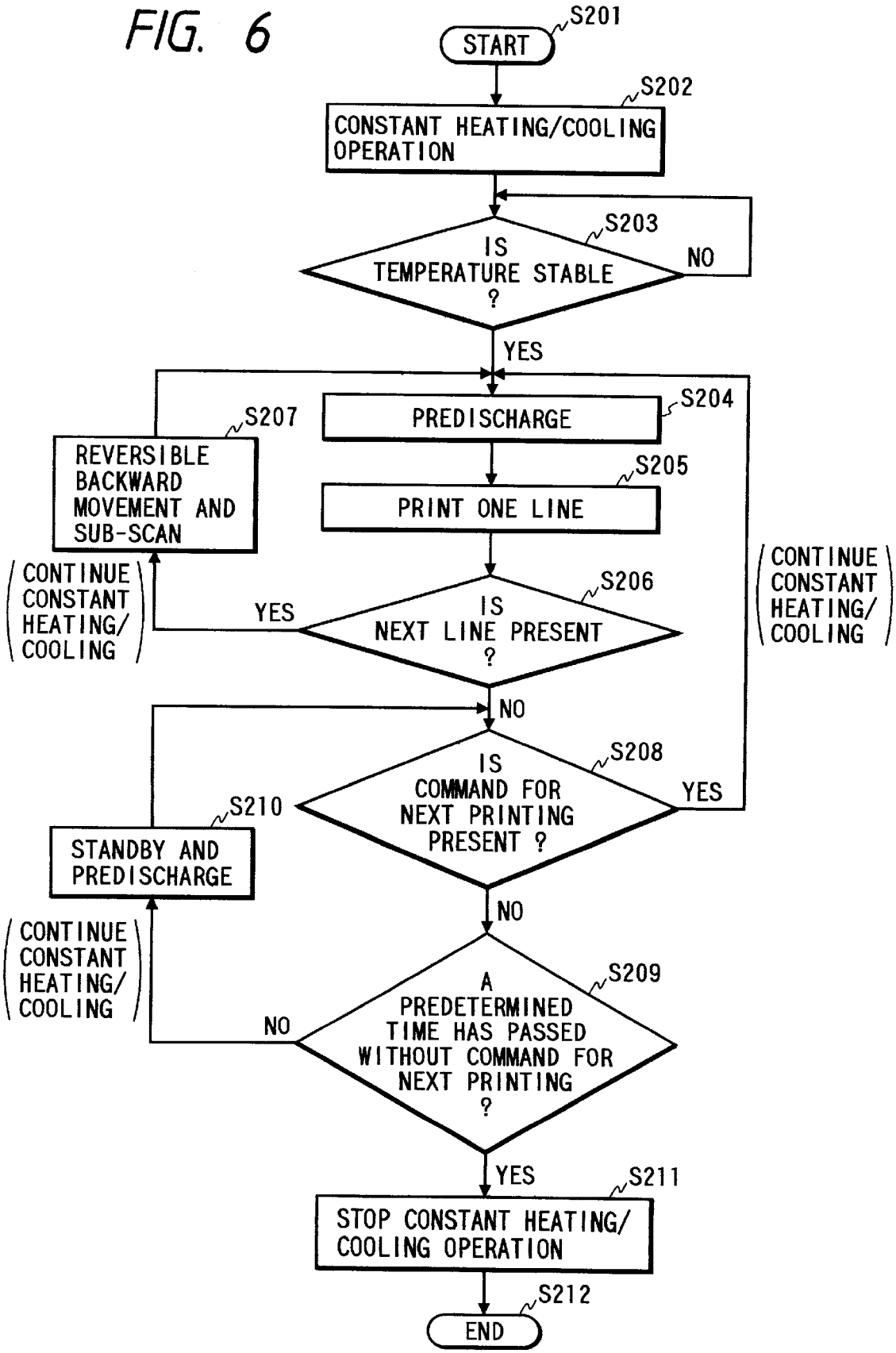
FIG. 6 is a flow chart which illustrates the recording operation in accordance with an embodiment of the present invention.

FIG. 6 is a flow chart which illustrates a serial scan printing operation in accordance with the present embodiment.

At first, in step S201, a starting signal is received. Then, immediately in step S202, the aforesaid control of the constant heat generation/constant cooling begins with respect to the printing head 1. In step S203, in anticipation of the control having arrived at the normal condition or its arrival at the normal condition has been detected, the printing operation begins. Then, if necessary, the predischarge is performed in step S204. In step S205, the printing is executed for one line portion. If it is determined in step S206 that there is the next line to be printed, the process will proceed to step S207 where the reversible and returning operation of the printing head 1 and the sub-scanning of the printing medium are executed, while continuing the control of constant heat, and then, the next line is printed.

In step S206, if there is no line to be printed next and the printing has been completed, it is determined in step S208 whether or not there is any printing signal for the next operation. If affirmative, the process will return to the step S204. If negative, the process will be on standby while executing predischarges intermittently as required in steps S209 and S210 for a specific period of time (in other words, it is made ready to start printing immediately the moment any printing command is received). If no printing command is received after a wait for a specific period of time, it is determined that no printing command will be received any longer. Then in step S211, the control of the constant heat generation/constant cooling is suspended, and in step S212, the operation will be terminated.

As described above, between the steps S210 and S211, the control of the constant heat generation/constant cooling is effectuated to control the nozzle temperature appropriately when the printing is in operation. Also, if, for example, the next printing command is received in the step S208, but it takes a long time to transfer the data, or in a similar case where a printing operation is essentially suspended for a long period, the control of the constant heat generation/constant cooling is suspended as the case may be. In this way, it may be possible to implement energy saving. In any case, it will suffice if only the temperature of the printing head 1 is in a stable condition when starting the printing.

In accordance with the present embodiment, it is possible to keep the temperature of nozzle 2 at a constant level in an extreme precision without depending on the printing duties and the history of printing operations. There is of course no possibility that the printing is disabled. It is possible to reproduce the recording densities and color appearance in extreme precision at all times. Unevenness in recorded images is not created, either.

In this respect, the first and second embodiments present the suitable examples for an ink jet printing apparatus that tends to be affected greatly by the heat generated by the printing head, that is, the ink jet recording apparatus using the method whereby to discharge ink by foaming ink. However, the present invention is not necessarily limited to such method. For example, it is applicable to an ink jet printing apparatus using the so-called piezo method where the strain effect of piezoelectric elements is utilized for discharging ink. In this piezo method, too, the heat of the printing head presents a great problem as in the case of the above-mentioned ink jet recording apparatus if the multi-nozzles are provided for the apparatus. This is because only part of the energy applied as recording signals is transformed into mechanical energy while most of the remaining energy turns into heat when the piezoelectric elements are used as the electro-mechanical transducing elements. Also, the transformed mechanical energy is only partly used for discharging ink. Most of such energy generates heat as the inner loss when the piezoelectric elements are caused to effectuate its transformation as electromechanical transducing elements. Also, much of the energy given to ink creates vibration of ink or the like so as to generate heat eventually.

(Third Embodiment)

Figure 7:
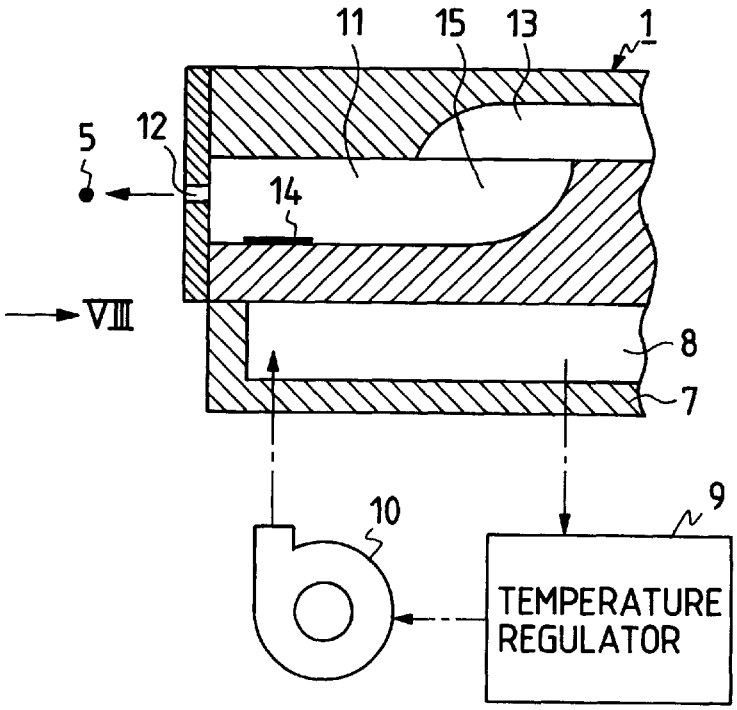
FIG. 7 is an enlarged cross-sectional view which shows a printing head in accordance with an embodiment of the present invention.
Figure 8:
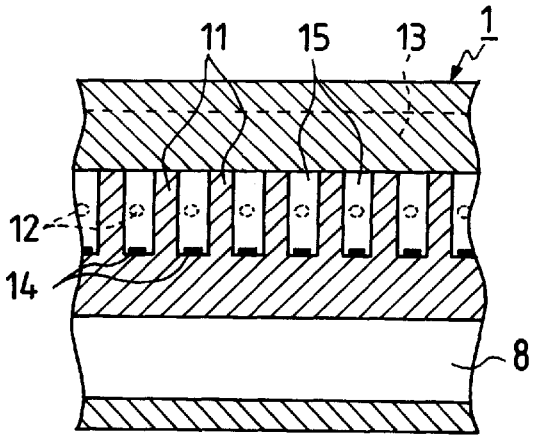
FIG. 8 is a view which shows the printing head represented in FIG. 7, observed in the direction indicated by an arrow VIII.

FIG. 7 and FIG. 8 are views which illustrate a third embodiment in accordance with the present invention. In the present embodiment, the description will be made of a suitable example of an ink jet printing apparatus using the piezo method described above.

In FIG. 7 and FIG. 8, a reference numeral 1 designates a piezo-method multinozzle, and 13, a common liquid chamber. From this common liquid chamber 13, ink is supplied to each individual liquid chamber 15 per nozzle. Then, ink is filled in each individual liquid chamber 15. In FIG. 7 and FIG. 8, the same reference numerals are applied to the same elements as those appearing in the first and second embodiments.

To the electrodes of the piezoelements serving as separation walls 11 of the nozzles, driving voltage is applied as recording signal. Then the separation walls 11 are distorted to make the volume of the corresponding individual liquid chamber 15 greater, and after that, distorted to make it smaller. An ink droplet 5 is discharged from the discharge port 12 at that time. In FIG. 8, the left and right separation walls 11 to constitute a nozzle on the second from the left are distorted to reduce the volume of the corresponding individual liquid chamber 15. This distortion is represented by dotted lines. On the lower end of the nozzle, a cooling device is arranged with a specific cooling function as in the embodiments described earlier.

Then, to the piezoelectric elements serving as the separation walls 11, the driving voltage serving as the recording signal is applied as described above, and also, the non-recording signal, which is also described above, is applied to the heater 14. Heat generation takes place to a certain extent even in driving the piezoelectric elements. Therefore, the heater 14, which serves as heating means, is caused to generate heat to the same extent as the heat of the piezoelectric element generated by recording. In this way, it is possible to cause the head 1 to generate heat at a constant rate irrespective of whether it operates recording or not. Between the recording signal given to the separation walls 11 and the non-recording signal given to the heater 14, the relationship of the energy intensity is the same as that of the embodiment described earlier. The ink droplet 5 is not allowed to be discharged by the non-recording signal given to the heater 14. Also, the temperature of the printing head 1 is controlled in the same manner as the embodiments described earlier.

In this respect, the present invention is not only applicable to the printing apparatus using the ink jet method, but also applicable to the printing apparatus using the thermal transfer method. In the latter case, it becomes possible to dispense with the control of temperature rise of a thermal head serving as a printing head and the complicated control to correct the accumulated heat as well. Moreover, it is possible to control the head temperature exactly, and reproduce the recording densities accurately.

Further, the present invention is not only applicable to the printing apparatus used for high recording duties, but also applicable to the printing apparatus for office use that requires only low recording duties. In the latter case, it becomes possible to reproduce the recording densities and color appearances in the high precision that has not been obtained in this field.

Also, as the temperature regulator 9, it is possible to employ a unit already on the market, which performs control by heating/cooling functions, such as "CARRY COOL": Type 300CN, a circulating cooler for liquid use dealt by Iuchi Seieido Co., Ltd.

(Fourth Embodiment)

Figure 9:
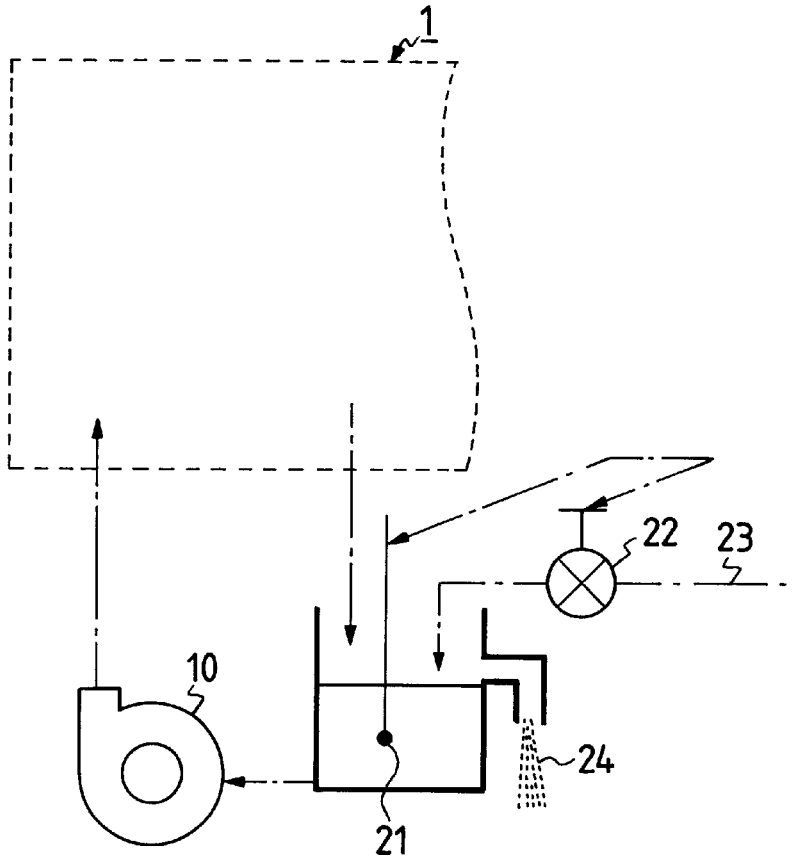
FIG. 9 and FIG. 10 are views schematically showing the principal part of an apparatus in accordance with one embodiment of the present invention.

FIG. 9 is a view which schematically shows an example in which a structure is simply prepared for the temperature regulator 9 in the embodiments described above.

In the present embodiment, the temperature of cooling water returning from the printing head 1 is detected by a temperature sensor 21, and then, the output of the temperature sensor 21 is fed back to an adjustment valve 22 in order to control the amount of cooling water 23 (city water, for instance) to be supplied from the outside, hence regulating the temperature of the printing head. Here, a reference numeral 24 designates a drain to cause the cooling water 23 from the outside to overflow so that any increased portion thereof is exhausted therefrom.

The temperature of the cooling water returning from the printing head 1 is higher than that of the cooling water 23 supplied from the outside because it is given heat by the printing head 1. Therefore, it is possible to make the temperature of the cooling water carried to the printing head 1 lower than that of the cooling water returning from the printing head by controlling the amount of the cooling water to be additionally supplied from the outside.

In accordance with the present embodiment, there is no need for the provision of such temperature regulator as the "CARRY COOL" having both heating and cooling functions as described above. As a result, it is possible to keep the temperature of the printing head at a constant level just by arranging the simple structure of the temperature regulator 9.

(Fifth Embodiment)

Figure 10:
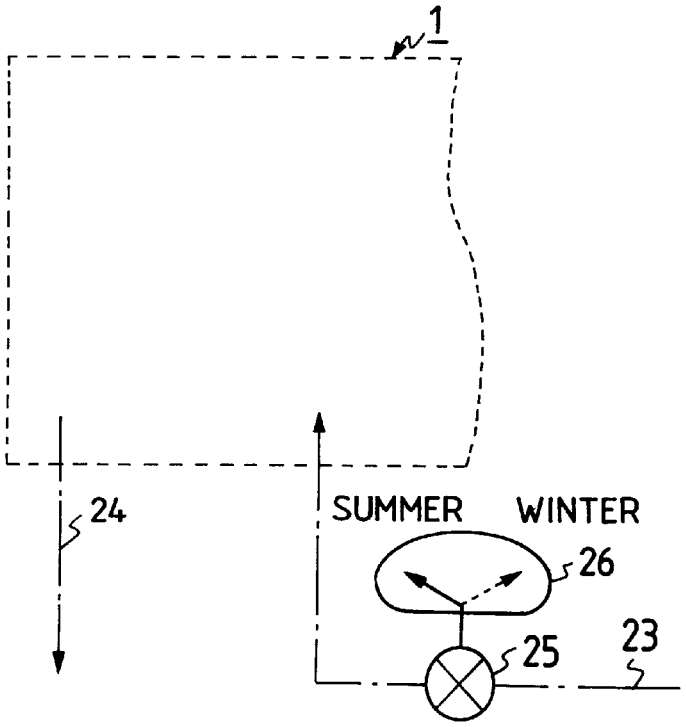

FIG. 10 is a view which shows an example in which the temperature regulator 9 described in the first and second embodiments is structured more simply.

In the present embodiment, the flow rate of the cooling water 23 is regulated just by a manual adjustment valve 25. As the cooling water 23, underground water or city water, whose temperature does not change much for a short period of time, is used. It may be possible to regulate the supply path of the cooling water 23 by use of a change over lever 26 for summer or winter use. In the case of the present embodiment, even the temperature sensor 21 is omitted from the arrangement provided for the third embodiment.

In the present embodiment, the description has been made of the change over lever 26 as being switchable in two ways, one for summer use and the other for winter use. The present invention is not necessarily limited thereto. It may be possible to arrange the lever so that it is switchable in accordance with the room temperature of the location where the apparatus is installed or the temperatures of the cooling water 23. Also, it may be possible to structure the lever so that it is switchable in multiple steps.

Now, in the cases of the fourth and fifth embodiments, the precision of temperature control should be lowered, but if many sets of printing apparatuses are installed as printing facilities for industrial use, it may be possible to arrange such simple structure for several of them as exemplified in those embodiments, and organize the apparatuses as being dedicated to producing prints that may admit of moderate recording precision. In this way, the total costs may be reduced for preparing such facilities.

(Other Embodiments)

In executing the present invention, it is possible to obtain particularly excellent effects by use of the printing head and printing apparatus, among those adopting the ink jet recording method, using the method provided with means for generating thermal energy to be utilized as energy for discharging ink, which is capable of changing states of ink when the thermal energy is applied. As means for generating thermal energy, electrothermal transducing elements, laser beam, or the like may be cited. With the adoption of such method, it is possible to achieve printing in a higher density and precision.

Also, it is possible to apply the present invention widely to various kinds of ink jet recording apparatuses, and particularly to the ink jet recording apparatuses for industrial use. It is preferably executable for the ink jet textile printing apparatuses, for example. With the application of the present invention, it is possible to improve the quality of recorded images by, and the productivity of the ink jet textile printing apparatuses.

Now, the description will be made of the entire steps of ink jet textile printing executed by the application of the present invention. After having completed the ink jet textile printing by use of the ink jet recording apparatus described above, the printed fabric is dried (including natural drying). Subsequently, the dyes on fiber texture are diffused, and a step is taken to cause the dyes to react and fix them on the fabric. In this step, a sufficient coloring, and durability by the fixation of dyes are obtained.

For the diffusion and reactive fixation, conventionally known steps are adoptable. For example, the steaming method will do. Here, in this case, it may be possible to give alkali treatment to the fabric in advance before the printing process is executed.

After that, in the additional processes, non-reactive dyes and substances used for the preceding processes are removed. Lastly, then, the recording is completed through the adjustment finish such as defect correction, ironing finish, and other related steps.

Now, particularly for the fabric used for the ink jet printing, the following properties are required:

(1) The color of ink should come out in a sufficient density.

(2) The degree of exhaustion of ink should be high.

(3) Ink should dry quickly on the fabric.

(4) Ink should not blur irregularly on the fabric.

(5) The fabric should be easy to be carried in the apparatus.

In order to satisfy these properties, it is possible in the present invention to pre-process the fabric as required. For example, in accordance with Japanese Patent Laid-Open Application No. 62-53492, there are disclosed fabric provided with a layer for receiving ink. Also, in Japanese Patent Publication No. 3-46589, it is proposed to provide the fabric in which reduction preventive agent or alkaline substance is contained. As an example of such pre-process, a treatment is made to enable these textiles to contain a substance selected from among alkaline substance, water soluble polymer, synthetic polymer, water soluble metallic salt, urea, and thiourea.

The alkaline substance is, for example, sodium hydroxide, potassium hydroxide, or other sodium alkaline metals, mono-, di-, tri-ethanol amine or other amine group, sodium carbonate, sodium bicarbonate, or other carbonates, alkaline metallic bicarbonate salt or the like. Further, there can be cited organic metallic salt such as calcium acetate, barium acetate, or ammonia and ammonia compound or the like. Also, it is possible to use the trichloro natrium acetate or the like that is transformed into alkaline substance by the application of steaming and drying heat. Particularly, preference is given to natrium carbonate and natrium bicarbonate as an alkaline substance, which is usable as a dye color of reactive pigment.

As the water soluble polymer, there can be cited, for example, starch such as corn, wheat, cellulose substance such as carboxymethyl cellulose, methyl cellulose, hydroxyethyl cellulose, polysaccharide such as natrium alginic acid, arabian, loquasweet bean, tragacanth, guam rubbers, and tamarind seed, protein substance such as gelatin, casein, and water soluble natural polymers such as tannic substance and lignin substance.

Also, as the synthetic polymer, there can be cited, for example, polyvinyl alcoholic compound, polyethylene oxide compound, alkali acid water soluble polymer, maleic anhydride water soluble polymer or the like. Of these substances, it is preferable to use polysaccharide polymer or cellulose polymer.

As water soluble metallic salt, there can be cited, for example, alkali metals or a compound of pH 4 to 10, which forms typical ionic crystals, such as halogenous compound of alkaline earth metals. As typical examples of such compounds, there can be cited NaCl, $Na_2SO_4$, KCl and $CH_3COONa$, or the like. Also, as alkaline earth metals, $CaCl_2$ and $MgCl_2$ or the like can be used. Of these substances, salt groups such as Na, K and Ca are preferable.

In the preceding processes, the methods for enabling fabric to contain those substances and others are not particularly limited. It may be possible to adopt a usually performed dipping method, a padding method, a coating method, or a spraying method, among others.

Further, the textile printing ink, which is applicable to fabric for use of ink jet printing, is such as just adhering to the textiles when applied onto them for printing. Therefore, it is preferable to execute a fixing process so that the color pigments in ink such as dyes should be fixed to the textiles. For a fixing process of the kind, any one of known methods is usable. For example, a steaming method, an HT steaming method, or a thermofixing method can be cited. If no alkali treatment is given to them in advance, there can be cited an alkali pad steaming method, an alkali blotch steaming method, an alkali shock method, an alkali cold fixing method, among others. Also, for the fixing process, there are those which include a reaction process or do not include it depending on the dyes to be used. Among those which do not include this process, there are some examples in which the dyes are contained in the textures and do not allow them to be removed physically. Also, as ink, it is possible to use any one of them appropriately if only a required pigment is contained. It may also be possible to use the ink containing colors, not necessarily dyes.

Further, in order to remove the non-reactive dyes and the substances used in the preceding process, rinsing may be applied in accordance with the conventionally known method after having executed the reactive fixation as described above. In this respect, it is preferable to perform the conventional fixing process together when exercising the rinsing treatment.

The printed articles that have been given the post process as described above are cut in a desired size. Each of the pieces thus cut is given processes to make it a final product, such as sewing, bonding, welding, or the like, thus obtaining one piece, dress, necktie, swim suit or other clothing, or bed cover, sofa cover, handkerchief, curtain, or the like. The method for processing fabric to make it clothing or other daily necessities by means of sewing and others is a technique that is conventionally known.

In this respect, as a printing medium, there can be cited fabric, wall cloths, embroidery threads, wall papers, paper sheets, OHP films, anodized aluminum plates or various others that may be capable of being provided with given liquid by use of the ink jet technologies. The fabric includes all the textiles, nonwoven textiles, and other cloths irrespective of materials, weaving methods, and netting methods.

For the present invention, it is possible to employ not only the aforesaid ink jet printing method, but also various printing methods. With the adoption of an ink jet printing method to embody the present invention, significant effects are obtainable. Of the ink jet printing methods, it is possible to demonstrate particularly excellent effects by the application of a method having means for generating thermal energy to be utilized as energy for discharging ink, which is capable of changing states of ink when the thermal energy is applied. In other words, the adoption of printing head and apparatus using the bubble jet method advocated by Canon Inc. contributes to obtaining still better results. With the application of a method of the kind, printing is possible in a higher density and precision.

Regarding the typical structure and operational principle of such method, it is preferable to adopt those which can be implemented using the fundamental principle disclosed in the specifications of U.S. Pat. Nos. 4,723,129 and 4,740,796. This method is applicable to the so-called on-demand type printing system and a continuous type printing system as well. Particularly, however, the method is suitable for the on-demand type because the principle is such that at least one driving signal, which provides a rapid temperature rise beyond a departure from nucleation boiling point in response to printing information, is applicable to an electrothermal transducer disposed on a liquid (ink) retaining sheet or liquid passage whereby to cause the electrothermal transducer to generate thermal energy to produce film boiling on the thermoactive portion of printing head, thus effectively leading to the resultant formation of a bubble in the liquid (ink) one to one for each of the driving signals. By. the development and contraction of the bubble, the liquid (ink) is discharged through a discharge port to produce at least one droplet. The driving signal is more preferably in the form of pulses because the development and contraction of the bubble can be effectuated instantaneously, and, therefore, the liquid (ink) is discharged with quick response. The driving signal in the form of pulses is preferably such as disclosed in the specifications of U.S. Pat. Nos. 4,463,359 and 4,345,262. In this respect, the temperature increasing rate of the heating surface is preferably such as disclosed in the specification of U.S. Pat. No. 4,313,124 for an excellent printing in a better condition.

The structure of the printing head may be as shown in each of the above-mentioned specifications wherein the structure is arranged to combine the discharge ports, liquid passages, and the electrothermal transducers (linear type liquid passages or right-angled liquid passages). Besides, the structure such as disclosed in the specifications of U.S. Pat. Nos. 4,558,333 and 4,459,600 wherein the thermal activation portions are arranged in a curved area is also included in the present invention. In addition, the present invention is effectively applicable to the structure disclosed in Japanese Laid-Open Application No. 59-123670 wherein a common slit is used as the discharge ports for plural electrothermal transducers, and to the structure disclosed in Japanese Patent Laid-Open Application No. 59-138461 wherein an aperture for absorbing pressure wave of the thermal energy is formed corresponding to the discharge ports.

In addition, it is of course possible to structure the printing head in accordance with the mode of a printing apparatus. With respect to the mode of the so-called line printer, it should be good enough if the printing head is structured so that its discharge ports are arranged over an area corresponding to the width of a printing medium. Also, for the printing head of a serial type as exemplified above, the present invention is effectively applicable to a printing head fixed to the apparats main body or to an exchangeable chip type, which can be electrically connected with the apparatus main body and ink is supplied from the apparatus main body to the head when it is installed in the apparatus main body, or to the printing head of a cartridge type in which an ink tank is formed together with the printing head itself.

Also, for the present invention, it is preferable to additionally provide a printing head with recovery means and preliminarily auxiliary means as constituents of the printing apparatus because these additional means will contribute to making the effectiveness of the present invention more stabilized. To name them specifically, these are capping means for the printing head, cleaning means, compression or suction means, preliminary heating means using electrothermal transducing elements or heating elements other than these transducing elements or combination of both elements, and predischarge means for executing discharges other than those for printing.

Also, in the embodiments of the present invention described above, while the ink has been described as liquid, it may be an ink material which is solidified below the room temperature but liquefied at the room temperature. Since the ink is controlled within the temperature not lower than 30° C. and not higher than 70° C. to stabilize its viscosity for the provision of the stable discharge in general for an ink jet method, the ink may be such as to be liquepred when the applicable printing signals are given. In addition, it may be possible to adopt the use of ink having a nature of being liquefied only by the application of heat so as to positively prevent the temperature from rising due to the thermal energy by use of such energy as an energy to be consumed for changing states of ink from solid to liquid, or to prevent ink from being evaporated by use of the ink which will be solidified when left intact. In any case, it may be possible to apply to the present invention such ink having a nature to be liquified only by the application of thermal energy, such as the ink, which is capable of being discharged as ink liquid by enabling itself to be liquefied when the thermal energy is applied in accordance with printing signals, and the ink, which will have already begun solidifying itself by the time it reaches a printing medium. In this case, it may be possible to retain ink in the form of liquid or solid in the recesses or through holes of a porous sheet such as disclosed in Japanese Patent Laid-Open application No. 54-56847 or 60-71260 in order to enable ink to face the electrothermal transducers. In the present invention, the most effective method adoptable for the various kinds of ink mentioned above is the one capable of implementing film boiling as described above.

Further, as the mode of the present invention, it may be possible to adopt a copying apparatus combined with a reader or the like in addition to the image output terminal for a computer, or other information processing apparatus.

As described above, in accordance with the printing apparatus of the present invention, it is possible to control the printing head to an appropriate temperature. Therefore, the recorded images provided by use of the printing apparatus of the present invention present uniform recording densities and excellent color reproducibility without unevenness in the printed images.

Also, the present invention is applicable not only to a small printing apparatus for office or personal use, but also to an ink jet printing apparatus for industrial use, having several thousands of nozzles per head for executing high duty recording. It is usable as a textile printer for printing on fabric, as an apparatus for fabricating color filters for use of display, or the like, not to mention a printer for printing on a large sized medium. In accordance with the present invention, it is possible to materialize the improvement of image quality for these kinds of printing apparatuses.

What is claimed is:

1. A printing apparatus having a printing head provided with a plurality of recording means for printing on a recording medium, said plurality of recording means generating heat upon being driven, said apparatus comprising:

a plurality of heat generating means for heating said printing head;

cooling means for cooling said printing head, said printing head being provided with a cooling flow path in which a cooling liquid flows along an arranging direction of said plurality of recording means, said cooling means having supply means for supplying the cooling liquid to said cooling flow path;

record control means for selectively driving said plurality of recording means in accordance with print data to record;

heat generation control means for controlling driving of said plurality of heat generating means such that in a period when recording is performed by driving said recording means a sum of heat generated by selectively driving the plurality of recording means by said record control means and heat generated by said plurality of heat generating means is substantially constant, wherein said heat generation control means drives said plurality of heat generating means in the period when recording is performed by driving the recording means; and cooling control means for causing said cooling means to cool said printing head in the period when recording is performed by causing the recording control means to drive said recording means.

2. A printing apparatus according to claim 1, wherein said printing head utilizes an ink jet method and is provided with discharge ports to print on the recording medium by discharging ink from said discharge ports.

3. A printing apparatus according to claim 2, wherein said recording means comprises electromechanical transducing means for discharging the ink from said discharge ports by application of pressure to ink.

4. A printing apparatus according to claim 3, wherein said electromechanical transducing means comprise piezoelectric elements which cause distortion by application of electric signals.

5. A printing apparatus according to claim 2, wherein said recording means comprises electrothermal transducing elements to apply thermal energy to the ink, and discharges the ink by application of the thermal energy generated by said electrothermal transducing elements.

6. A printing apparatus according to claim 5, wherein said plurality of heat generating means are arranged correspondingly for said plurality of recording means, and said heat generation control means generates heat insufficient to discharge ink in recording means that are not driven by said record control means.

7. A printing apparatus according to claim 1, wherein said plurality of recording means comprise electrothermal transducing elements to generate thermal energy, and said printing head comprises a thermal transfer head to transfer ink to the recording medium by application of the thermal energy generated by said electrothermal transducing means.

8. A printing apparatus for recording on a recording medium by discharging ink onto the recording medium, said apparatus having a printing head provided with discharge ports for discharging ink, and a plurality of discharge means for discharging the ink through said discharge ports, said plurality of discharge means being a plurality of electrothermal energy converting elements generating thermal energy to apply to the ink, said apparatus comprising:

cooling means for cooling said printing head, said printing head being provided with a cooling flow path in which a cooling liquid flows along an arranging direction of said plurality of discharge means, said cooling means having supply means for supplying the cooling liquid to said cooling flow path and temperature regulating means for regulating the temperature of said cooling liquid;

recording control means for selectively driving said plurality of discharge means in accordance with printing data to record;

heat generation control means for controlling generation of heat insufficient to discharge the ink in discharge means of said plurality of discharge means that are not driven by said recording control means, said heat generation control means controlling generated heat in accordance with heat generated by selectively driving the plurality of discharge means by said recording control means in a period when recording is performed by causing said recording control means to drive the discharge means; and cooling control means for causing said cooling means to cool said printing head in the period when recording is performed by causing the recording control means to drive the discharge means.

9. A printing apparatus according to claim 8, wherein said heat generation control means causes discharge means of said plurality of discharge means that does not discharge to generate thermal energy equal to the thermal energy generated in the printing head by driving one of said plurality of discharge means for ink discharge when operated by said recording control means.

10. A printing apparatus according to claim 8, wherein said heat generation control means controls and causes said electrothermal energy converting elements to keep the intensity of generated heat applied to said printing head within a predetermined range.

11. A printing apparatus according to claim 8, wherein the driving of said electrothermal energy converting elements is executed by application of at least one driving pulse.

12. A printing apparatus according to claim 11, wherein said heat generation control means controls application of a secondary pulse to each of the electrothermal energy converting elements not driven by said record control means in recording, the secondary pulse having a width smaller than that of the driving pulse applied for recording by said recording control means.

13. A printing apparatus according to claim 11, wherein said heat generation control means controls application of a plurality of secondary pulses to each of the electrothermal energy converting elements not driven by said record control means in recording, the plurality of secondary pulses each having a width smaller than that of the driving pulses applied for recording by said recording control means.

14. A printing apparatus according to claim 11, wherein said heat generation control means controls application of secondary pulses to each of the electrothermal energy converting elements not driven by said record control means in recording, the secondary pulses having a voltage lower than that of the driving pulses applied for recording by said recording control means.

15. A printing apparatus according to claim 8, wherein said cooling means is provided with temperature regulating means for regulating temperature of the cooling liquid.

16. A printing apparatus according to claim 15, wherein said temperature regulating means regulates the temperature by heating and cooling the cooling liquid.

17. A printing apparatus according to claim 8, wherein said cooling means cools said printing head by circulating the cooling liquid between said printing head and said cooling means.

18. A printing apparatus according to claim 17, wherein said cooling means is provided with temperature regulating means for regulating temperature of the cooling liquid, said temperature regulating means regulates the temperature of the cooling liquid by adding additional cooling liquid having a temperature lower than that of the cooling liquid returning from said printing head by circulation.

19. A printing apparatus according to claim 8, wherein said cooling means further comprises regulating means for regulating cooling of said printing head in plural increments.

20. A printing apparatus according to claim 8, further comprising:

temperature control means for controlling temperature of said printing head before a printing operation by use of said heat generation control means and said cooling means.

21. A printing apparatus according to claim 8, further comprising:

temperature control means for controlling temperature of said printing head for a predetermined time after a printing operation by use of said heat generation control means and said cooling means.

22. A printing apparatus according to claim 8, wherein said discharge means creates a change in state of the ink by application of the thermal energy, and discharges the ink by application of pressure generated by the change in state.

23. A method for controlling a temperature of a printing head of a printing apparatus having the printing head provided with a plurality of recording means for printing on a recording medium, said recording means generating heat upon being driven, said method comprising the steps of:

selectively driving said plurality of recording means in accordance with print data;

heating the printing head by a plurality of heat generating means, controlling heat generated in said heating step such that a sum of heat generated by selectively driving said plurality of recording means and heat generated by said plurality of heat generating means is substantially constant in a period when recording is performed by selectively driving said recording means; and cooling an area of said printing head including a region where heat is generated by said plurality of recording means in said heating step, cooling being effected by providing said printing head with a cooling flow path in which a cooling liquid flows along an arranging direction of said plurality of recording means, in said cooling step said printing head is cooled by circulating the cooling liquid in said cooling flow path, with temperature of said cooling liquid being regulated at a predetermined temperature.

24. A method for controlling temperature of a printing head of a printing apparatus for recording on a recording medium by discharging ink onto the recording medium, said apparatus having the printing head provided with discharge ports for discharging the ink, and a plurality of discharge means for discharging ink through said discharge ports, said plurality of discharge means being a plurality of electrothermal energy converting elements generating thermal energy to apply to the ink, said method comprising the steps of:

recording by selectively driving said plurality of discharge means in accordance with printing data;

heat generation controlling so as to generate heat insufficient to discharge the ink by discharge means not driven in said recording step, said heat generation controlling step controlling generated heat in accordance with heat generated by selectively driving said plurality of discharge means based on the print data in a period when recording is performed by selectively driving said discharge means; and cooling an area of the printing head including a region where thermal energy is generated by said plurality of discharge means in said heat generation controlling step, cooling by providing said printing head with a cooling flow path in which a cooling liquid flows along an arranging direction of said plurality of discharge means, in said cooling step said printing head being cooled by circulating the cooling liquid in said cooling flow path, the temperature of said cooling liquid being regulated at a predetermined temperature.

* * * * *

UNITED STATES PATENT AND TRADEMARK OFFICE

CERTIFICATE OF CORRECTION

PATENT NO. : 5,992,963

DATED : November 30, 1999

INVENTOR(S) : MIYAKE ET AL.

It is certified that error appears in the above-identified patent and that said Letters Patent is hereby corrected as shown below:

Title page, item

[57] ABSTRACT:

Line 13, "to discharge" should read --to be discharged--.

COLUMN 1:

Line 53, "printing" (first occurrence) should read --the printing--.

Line 57, "printing" should read --the printing--.

Line 58, "printing" should read --the printing--.

COLUMN 2:

Line 10, "head:here," should read --head. Here,--.

Line 28, "the" should read --this--.

COLUMN 4:

Line 15, "with" should read --with a--.

Line 46, "is to control" should read --controls--.

COLUMN 6:

Line 63, "botch" should read --batch--.

COLUMN 7:

Line 4, "thousand" should read --a thousand--.

Line 6, "FIG. 2A, FIG. 2A." should read --FIG. 2A. FIG. 2A--.

COLUMN 8:

Line 14, "to be recorded" should be deleted.

Line 44, "in" should read --with--.

UNITED STATES PATENT AND TRADEMARK OFFICE

CERTIFICATE OF CORRECTION

PATENT NO. : 5,992,963

DATED : November 30, 1999

INVENTOR(S) : MIYAKE ET AL.

It is certified that error appears in the above-identified patent and that said Letters Patent is hereby corrected as shown below:

COLUMN 10:
Line 16, "in an" should read --with--.

COLUMN 12:
Line 15, "change over" should read --change-over--.
Line 20, "change over" should read --change-over--.
Line 32, "such" should read --such a--.

COLUMN 13:
Line 32, "group," should read --groups,--.

COLUMN 15:
Line 46, "apparats" should read --apparatus--.

Signed and Sealed this

Sixteenth Day of January, 2001

*Attest:*

*Attesting Officer*

Q. TODD DICKINSON

*Commissioner of Patents and Trademarks*